US008862032B2

(12) United States Patent
Hayashi

(10) Patent No.: US 8,862,032 B2
(45) Date of Patent: Oct. 14, 2014

(54) TONER SUPPLY DEVICE AND IMAGE FORMING APPARATUS USING SAME

(75) Inventor: Hideji Hayashi, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 100 days.

(21) Appl. No.: 13/353,349

(22) Filed: Jan. 19, 2012

(65) Prior Publication Data

US 2012/0189351 A1 Jul. 26, 2012

(30) Foreign Application Priority Data

Jan. 21, 2011 (JP) ..... 2011-10320

(51) Int. Cl.
*G03G 15/08* (2006.01)
*G03G 15/01* (2006.01)

(52) U.S. Cl.
CPC ..... *G03G 15/0879* (2013.01); *G03G 15/0189* (2013.01); *G03G 2215/0132* (2013.01)
USPC ..... 399/258; 399/263

(58) Field of Classification Search
USPC ..... 399/263
See application file for complete search history.

(56) References Cited

U.S. PATENT DOCUMENTS

2009/0233201 A1* 9/2009 Kawaguchi ..... 430/108.1

FOREIGN PATENT DOCUMENTS

| | | | | |
|---|---|---|---|---|
| JP | 2006-126433 A | | 5/2006 | |
| JP | 200772347 A | | 3/2007 | |
| JP | 200839986 A | | 2/2008 | |
| JP | 2008-287214 A | | 11/2008 | |
| JP | 2009-210721 | * | 9/2009 | ..... G03G 15/08 |
| JP | 2009-210721 A | | 9/2009 | |
| JP | 2010156910 A | | 7/2010 | |

OTHER PUBLICATIONS

Office Action from Japanese Patent Office dated May 7, 2013, issued in corresponding Japanese Patent Appln. No. 2011-010320, with English translation thereof (9 pages).

* cited by examiner

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

In a transport pipe having a first opening portion through which toner is fed in from a toner hopper and a second opening portion through which the toner is discharged to a development device, a transport screw in which a helical blade is formed on a rotational shaft is rotatably provided. The width of the first opening portion in the direction of the rotational shaft is greater than the pitch (L0) of the blade at the first opening portion, and, at the downstream end of the first opening portion in the transport direction, the pitch of the blade is switched from the pitch (L0) to a pitch (L1) which is narrower than the pitch (L0). In this way, the amount of transport of the toner from the toner hopper to the development device with the transport screw is stabilized.

6 Claims, 4 Drawing Sheets

TONER SUPPLY DEVICE AND IMAGE FORMING APPARATUS USING SAME

This application is based on Japanese Patent Application No. 2011-10320 filed on Jan. 21, 2011, the contents of which are hereby incorporated by reference.

BACKGROUND OF THE INVENTION

1. Field of the Invention

The present invention relates to a toner supply device and an image forming apparatus incorporating such a toner supply device.

2. Description of the Related Art

In an electrophotographic image forming apparatus such as a facsimile, a printer or a copying machine, the amount of toner consumed in a development device is supplied from a toner storage portion, and thus the concentration of toner within the development device is maintained. The toner may be supplied from the toner storage portion to the development device by the rotation of a transport screw.

It is important to stabilize the amount of toner transported by the transport screw not only to maintain the concentration of toner within the development device but also to estimate the amount of toner left in the toner storage portion from a period of time during which the transport screw is driven.

Hence, for example, document 1 (Japanese Unexamined Patent Application Publication No. 2006-126433) proposes a technology in which a cylindrical portion including a transport screw is provided substantially in a horizontal direction such that its length is one to three times as great as the pitch of the transport screw. Moreover, document 2 (Japanese Unexamined Patent Application Publication No. 2008-287214) discloses a technology in which a toner transport path is inclined such that a downstream side in a toner transport direction is higher than an upstream side, and in which, while a transport screw is stopped, toner is prevented from dropping to a development device due to its weight. Furthermore, document 3 (Japanese Unexamined Patent Application Publication No. 2009-210721) discloses a technology in which a force that compresses toner by a transport unit is increased as a toner transport direction extends to a downstream side, and also discloses, as one method of increasing the toner compressing force, a configuration in which the pitch of the blades of a transport screw is decreased as the toner transport direction extends from the upstream side to the downstream side.

However, even with the technologies disclosed in patent documents 1 and 2, the amount of transport of the toner with the transport screw is not sufficiently stabilized. In the technology disclosed in patent document 3, although, when the amount of toner in the toner storage portion is decreased, the amount of transport of the toner is probably stabilized, when a large amount of toner is stored in the toner storage portion, it is likely that, since excessive toner taken in an entrance portion of the transport screw cannot be returned to the toner storage portion, the amount of transport of the toner is varied.

In view of the foregoing conventional problems, the present invention is made; an object of the present invention is to stabilize the amount of transport of toner with a transport screw, both in a toner supply device that supplies, using the transport screw, toner from a toner storage portion to a development device and in an image forming apparatus.

SUMMARY OF THE INVENTION

According to the present invention, there is provided a toner supply device that includes: a toner storage portion which stores toner therewithin; and a transport unit which transports the toner stored in the toner storage portion to a development device. In the toner supply device, the transport unit includes: a transport pipe having a first opening portion through which the toner is fed in from the toner storage portion and a second opening portion through which the toner is discharged to the development device; and a transport screw which is provided within the transport pipe and in which a helical blade is formed on a rotational shaft, the width of the first opening portion in the direction of the rotational shaft of the transport screw is greater than a pitch of the blade at the first opening portion and the pitch of the blade is switched at a downstream end of the first opening portion in a transport direction such that a pitch on a downstream side is narrower than a pitch on an upstream side.

Here, in order for the amount of transport of the toner to be more stabilized, the pitch of the blade preferably becomes narrower either continuously or stepwise from the downstream end of the first opening portion in the transport direction to the upstream end of the second opening portion in the transport direction.

The pitch of the blade at the second opening portion is preferably greater than a pitch immediately before the upstream end of the second opening portion in the transport direction.

Furthermore, the width of the second opening portion in the direction of the rotational shaft is preferably greater than the width of the first opening portion in the direction of the rotational shaft.

An image forming apparatus according to the present invention includes a development device and a toner supply device which supplies toner to the development device; as the toner supply device, any one of the toner supply devices described above is used.

DESCRIPTION OF PREFERRED EMBODIMENTS

Although the present invention is described in further details below using examples, the present invention is not limited to these examples.

Although an image forming apparatus and a toner supply device according to the present invention are described below with reference to accompanying drawings, the present invention is not limited to these at all.

Figure 1:
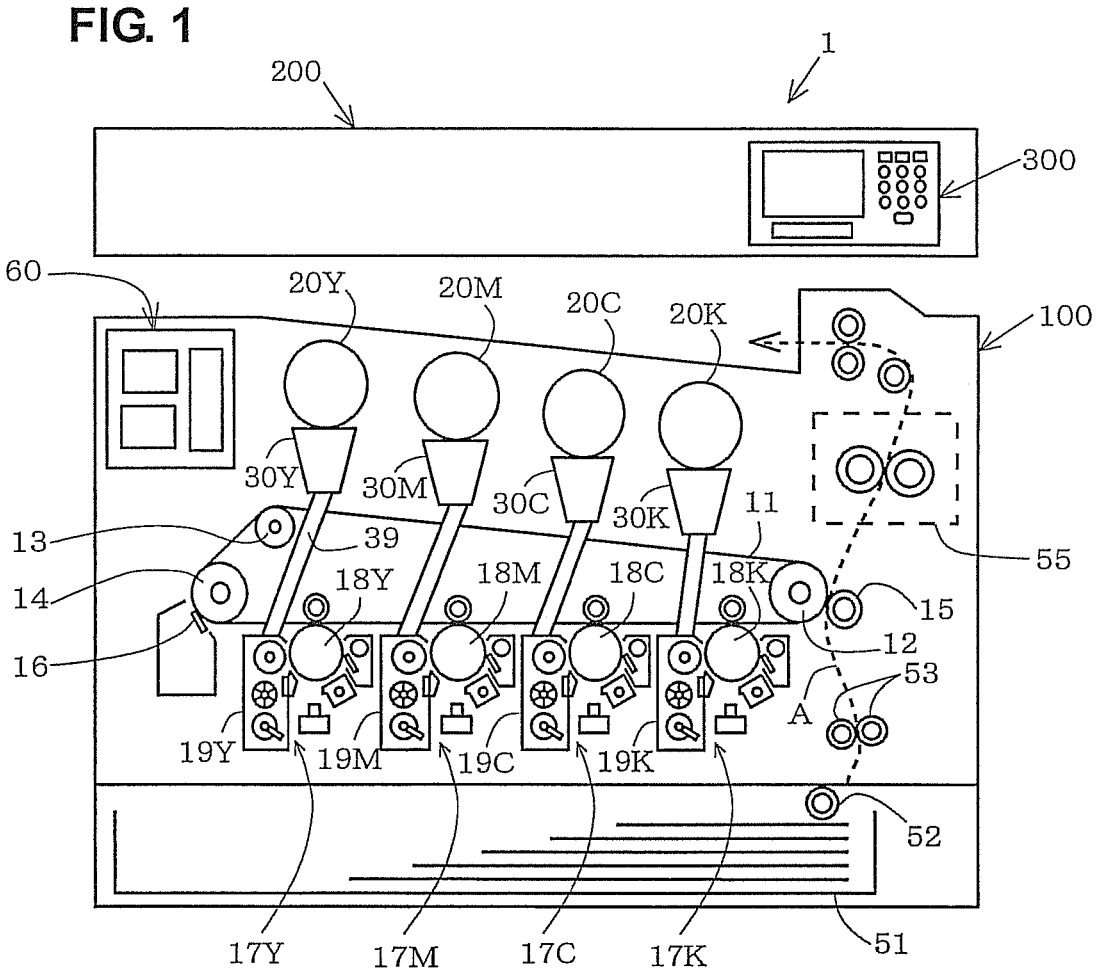
[FIG. 1] A diagram showing an example of the configuration of an image forming apparatus according to the present invention.

FIG. 1 shows an example of the configuration of the image forming apparatus according to the present invention. The image forming apparatus 1 shown in FIG. 1 is tandem color digital copying machine, and is formed with an image reader portion 200 that mainly reads an original document image, a printer portion 100 that prints the read image on a transfer member such as a recording sheet and an operation display portion 300 to which a user inputs printing conditions and which displays the status of the operation of the device and the result of the input by the user.

The image reader portion 200 is a known image reader that reads an original document placed on an unillustrated original document glass plate by moving a scanner. The original document image is divided into three colors that are red (R), green (G) and blue (G), and they are converted by an unillustrated CCD (charge coupled device) image sensor into electrical signals, with the result that image data on R, G and B is obtained.

A control portion 60 performs various types of processing on the image data on the individual colors obtained in the image reader portion 200, then the resulting image data is converted into image data on individual reproduction colors that are cyan (C), magenta (M), yellow (Y) and black (K) and the image data is stored in a memory within the control portion 60. The image data on the individual reproduction colors stored in the control portion 60 is subjected to position displacement correction, is then read on an individual scanning line basis in synchronization with the supplying of a recording sheet and becomes a signal for driving a light-emitting diode.

The printer portion 100 forms an image electrophotographically. An intermediate transfer belt 11 is strung between a drive roller 12, a tension roller 13 and a driven roller 14. The tension roller 13 receives a force that is exerted by an unillustrated spring and that acts upward in FIG. 1, and thus a tension is applied to the intermediate transfer belt 11. The intermediate transfer belt 11 is rotated counterclockwise in FIG. 1 by the drive roller 12. A secondary transfer roller 15 is pressed onto the drive roller 12 through the intermediate transfer belt 11. In a position opposite the driven roller 14A, a cleaning blade 16 for scraping toner left on the intermediate transfer belt 11 is pressed onto the intermediate transfer belt 11.

Below the intermediate transfer belt 11, image formation portions 17Y, 17M, 17C and 17K (hereinafter also referred to as the "image formation portion 17") of the individual colors, which are yellow (Y), magenta (M), cyan (C) and black (K), are spaced a predetermined distance apart. All the image formation portions 17 have the same configuration; around photoconductor drums 18Y, 18M, 18C and 18K (hereinafter also referred to as the "photoconductor drum 18") rotating clockwise, charging devices, exposure portions, development devices 19Y, 19M, 19C and 19K (hereinafter also referred to as the "development device 19"), transfer rollers and cleaning portions are respectively arranged.

The transfer members are sequentially pulled out of a paper feed cassette 51 by a paper feed roller 52 to a transport path A such that the transfer members are fed from the uppermost one to the lowermost one, and the transfer member is transported to resist rollers 53. Then, the transfer member is fed to a nip portion between the intermediate transfer belt 11 and the secondary transfer roller 15 in synchronization with the rotation of the intermediate transfer belt 11.

An electrostatic latent image is formed on the surface of the photoconductor drum 18 by the charging device and the exposure portion, and the electrostatic latent image on the surface of the photoconductor drum 18 is visualized by the development device 19. Then, a toner image formed on the surface of the photoconductor drum 18 is primarily transferred onto the intermediate transfer belt 11 when the intermediate transfer belt 11 passes between the photoconductor drum 18 and the transfer roller. Then, when the transfer member pulled out of the paper feed cassette 51 moves along a broken line A and passes through the nip portion between the intermediate transfer belt 11 and the secondary transfer roller 15, the toner image on the intermediate transfer belt 11 is secondarily transferred to the transfer member. Thereafter, the transfer member is transported to a fixing portion 55 where the transfer member is heated and pressurized and the toner image is fixed to the transfer member. Then, the transfer member to which the toner image has been fixed is ejected to the outside of the device. On the other hand, the toner left on the intermediate transfer belt 11 is collected by the cleaning blade 16, and is stored in a waste toner box.

The individual development devices 19 of the image formation portions 17 are connected through cylindrical joints 39 to toner hoppers (toner storage portions) 30Y, 30M, 30C and 30K (hereinafter also referred to as the "toner hopper 30") that store the toners of the individual colors. When the concentration of the toner within the development device 19 is decreased, the toner is supplied from the toner hopper 30 to the development device 19 by a toner supply device, which will be described later. Above the toner hoppers 30, toner bottles 20Y, 20M, 20C and 20K (hereinafter also referred to as the "toner bottle 20") are removably provided. When the amount of toner left in the toner hopper 30 is decreased, the toner is supplied from the toner bottle 20 to the toner hopper 30. When the toner within the toner bottle 20 runs out, it is replaced with a new toner bottle 20. An example of the toner bottle 20 is a cylindrical bottle in which helical protrusions are formed on its inner circumferential surface. In this toner bottle, toner within the bottle is transported, by the rotation of the toner bottle 20, to a discharge port formed in the bottle.

Figure 2:
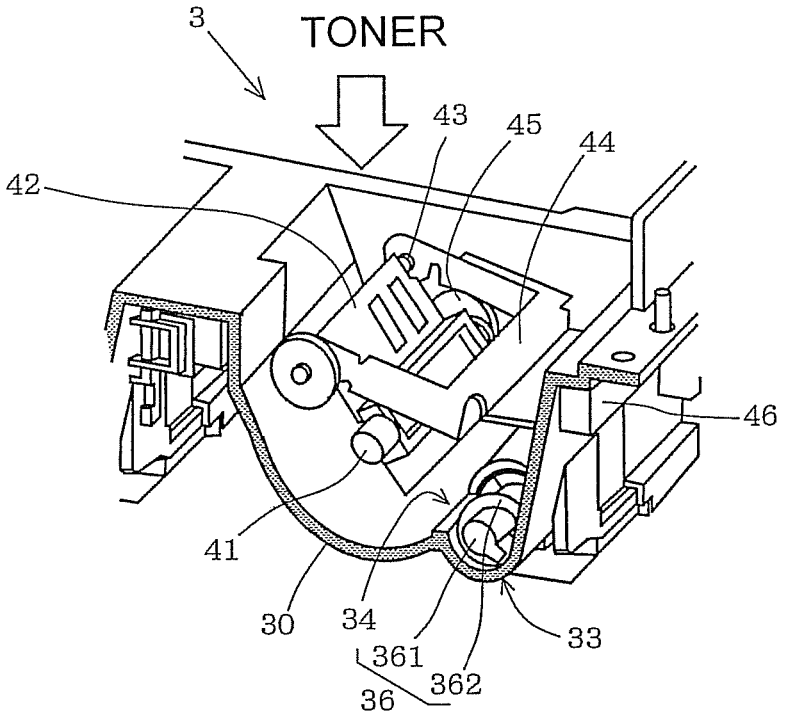
[FIG. 2] A perspective cross-sectional view showing an embodiment of a toner supply device of the present invention.
Figure 3:
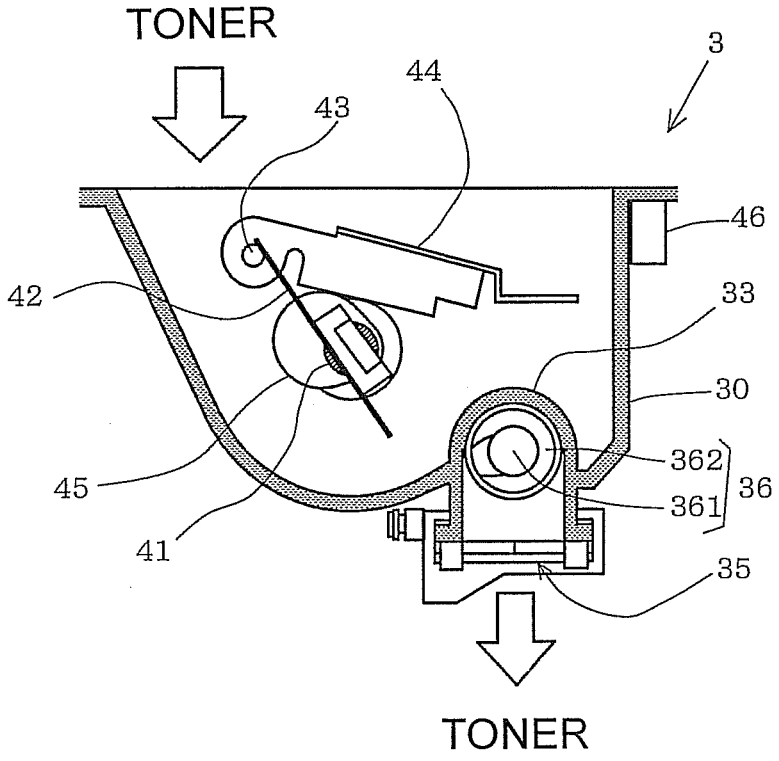
[FIG. 3] A cross-sectional view of the toner supply device of FIG. 2.

FIGS. 2 and 3 show a perspective view and a vertical cross-sectional view of the toner supply device 3. An agitation blade 42 is rotatably provided about a rotational shaft 41 substantially in the center of the toner hopper 30, and agitates the toner stored in the toner hopper 30. Both ends of a detection plate 44 that is U-shaped when seen in plan view are supported by a pin 43 formed on the opposite inner side surfaces of the toner hopper 30 such that the detection plate 44 freely swings. An eccentric cam 45 provided on the rotational shaft 41 is pressed onto the detection plate 44; as the rotational shaft 41 rotates, the detection plate 44 repeatedly moves upward and downward about the pin 43. The detection plate 44 moves upward and downward according to the amount of toner within the toner hopper; the position of the detection plate 44 is detected by a detection sensor 46 provided on the outside surface of the toner hopper 30. For example, a magnet is provided on the swinging end portion of the detection plate 44, and a reed switch is used as the detection sensor 46.

When the amount of toner left in the toner hopper 30 is detected to be equal to or less than a predetermined amount, for example, the toner bottle 20 (see FIG. 1) is rotated to supply the toner from the toner bottle 20 to the toner hopper 30. When, even if the toner bottle 20 is rotated, the signal of the detection sensor 46 of the toner hopper 30 is not changed, the toner bottle 20 is determined to be empty, and a display indicating that the toner bottle 20 needs to be replaced with a new toner bottle 20 is produced on the operation display portion 300 (see FIG. 1) to provide a notification to the user.

In a corner of the bottom portion of the toner hopper 30, a transport pipe 33 is formed integrally with the toner hopper 30. A first opening portion 34 is formed in a portion facing the inside of the toner hopper 30. In a connection portion to the joint 39 (see FIG. 1) on the other end side of the transport pipe 33, a second opening portion 35 (see FIG. 3) is formed. Within the transport pipe 33, a transport screw 36 in which a helical blade 362 is formed on the outer circumference of a rotational shaft 361 is rotatably provided.

When the toner concentration sensor (not shown) of the development device 19 detects the concentration of the toner within the development device 19 to be equal to or less than a predetermined amount, the transport screw 36 is rotated, and the toner within the toner hopper 30 is supplied to the development device 19 through the first opening portion 34, the transport pipe 33, the second opening portion 35 and the joint 39.

It is important to stabilize the amount of transport of the toner from the toner hopper 30 to the development device 19 so that the concentration of the toner in the development device 19 can be maintained and that the amount of toner left in the toner hopper 30 and the toner bottle 20 can be accurately estimated using a period of time during which the transport screw 36 is driven. Hence, in the toner supply device of the present invention, the amount of transport of the toner from the toner hopper 30 to the development device 19 is stabilized with the following configuration. The width of the first opening portion 34 of the transport pipe 33 in the direction of the rotational shaft is greater than the pitch of the blade 362 of the transport screw 36 at the first opening portion 34, and thus a larger amount of toner is fed into the transport pipe 33; and at the downstream end S1 (see FIG. 4) of the first opening portion 34 in a transport direction, the pitch of the blade 362 of the transport screw 36 is switched such that the pitch is reduced, and thus an excessive amount of toner fed into the transport pipe 33 is returned to the toner hopper 30 at the downstream end of the first opening portion in the transport direction. The toner supply device of the present invention will be described in detail below.

Figure 4:
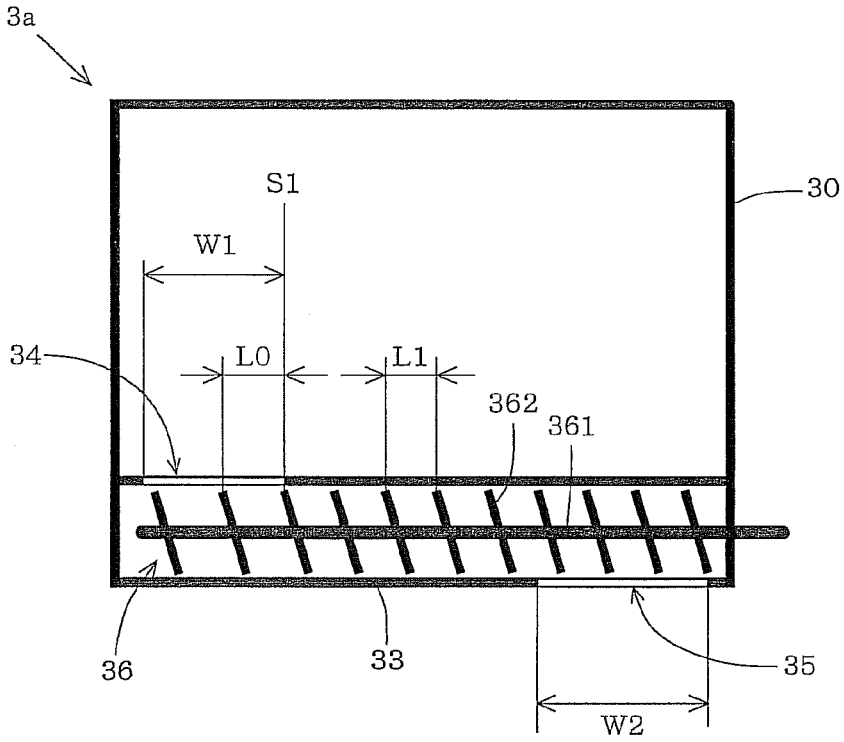
[FIG. 4] A schematic diagram showing a first embodiment of the toner supply device of the present invention.

FIG. 4 is a schematic diagram showing a first embodiment of the toner supply device according to the present invention. In this figure, for ease of understanding of the present invention, the agitation blade 42, the detection plate 44 and the like provided within the toner hopper 30 are not shown. In the toner supply device 3*a* of the figure, the first opening portion 34 that is open to the inside of the toner hopper 30 and the second opening portion 35 that is open to the joint 39 (see FIG. 1) are formed in the transport pipe 33 formed in a bottom portion of the toner hopper 30. The pitch of the transport screw 36 provided within the transport pipe 33 is a pitch L0 in a portion opposite the first opening portion 34, and is switched from the pitch L0 to a narrow pitch L1 at the downstream end S1 of the first opening portion 34 in the transport direction. The width W1 of the first opening portion 34 in the direction of the rotational shaft is set greater than the pitch L0 of the transport screw 36; the width W2 of the second opening portion 35 is set greater than the width W1 of the first opening portion 34. The width W2 of the second opening portion 35 is determined as appropriate from the inside diameter of the joint 39 and, when the toner hopper 30 is connected directly to the development device 19 without the use of the joint 39, the shape, the size and the like of the connection portion. Although the width W2 of the second opening portion 35 may be narrower than the width W1 of the first opening portion 34, the width W2 of the second opening portion 35 is preferably greater than the width W1 of the first opening portion 34 so that the toner is smoothly supplied.

In the toner supply device configured as described above, when the toner is supplied from the toner hopper 30 to the development device 19, the transport screw 36 is rotated by an unillustrated drive source. The toner fed into the transport pipe 33 through the first opening portion 34 is transported by the transport screw 36 in the direction of the second opening portion 35. Then, at the downstream end S1 of the first opening portion 34 in the transport direction, the pitch of the blade 362 of the transport screw 36 is switched from the pitch L0 to the pitch L1 that is narrower than the pitch L0, and thus a compression force is applied to the toner. Hence, the density of the toner is increased, and an excessive amount of toner that cannot be kept within the blade of the transport screw 36 is returned into the toner hopper 30 through the first opening portion 34 at the position S1. Thus, it is possible to stabilize the amount of toner transported by the transport screw 36. Then, the toner is passed through the transport pipe 33 and is supplied to the development device 19 through the second opening portion 35 and the joint 39.

Figure 5:
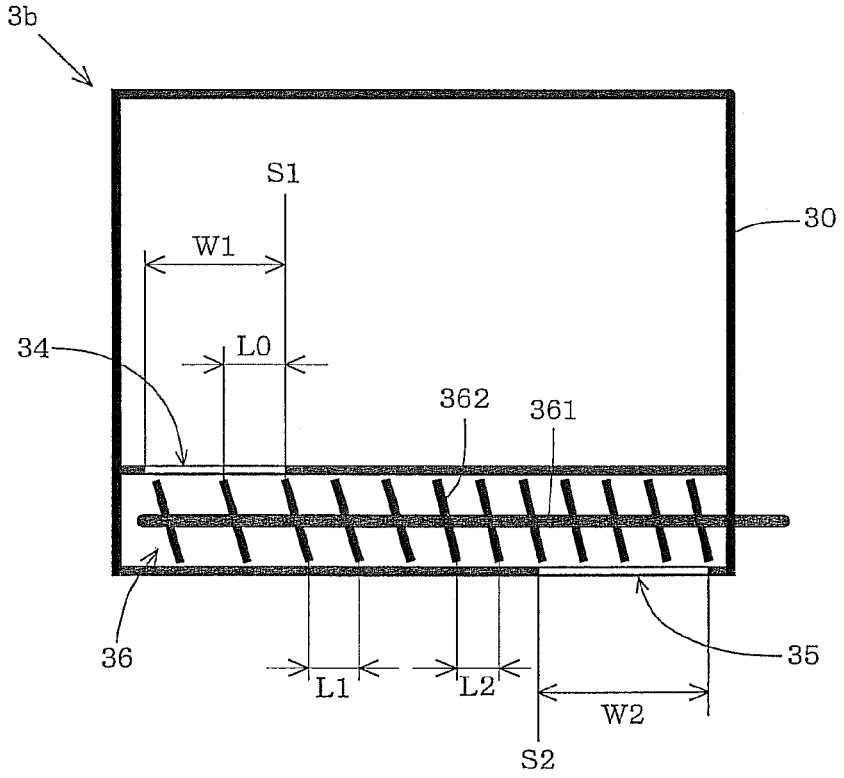
[FIG. 5] A schematic diagram showing a second embodiment of the toner supply device of the present invention.

FIG. 5 shows a second embodiment of the toner supply device according to the present invention. The toner supply device 3*b* shown in this figure differs from that of the first embodiment in that, between the downstream end S1 of the first opening portion 34 in the transport direction and the upstream end S2 of the second opening portion 35 in the transport direction, the pitch of the blade 362 of the transport screw 36 is switched from the pitch L1 to a pitch L2 that is narrower than the pitch L1. In this way, a further compression force is applied to the toner, and, even when uneven small spaces between toner particles are present, the density of the toner is made uniform. The pitch of the blade 362 of the transport screw 36 between the point S1 and the point S2 may be reduced in a plurality of steps or may be reduced continuously.

Figure 6:
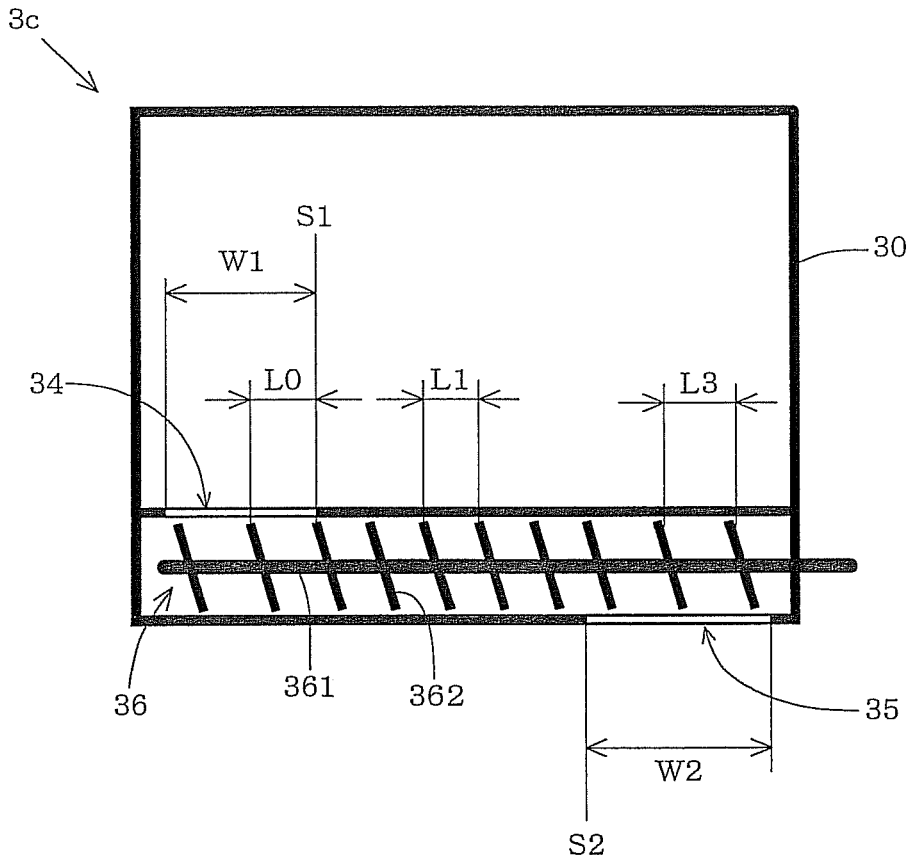
[FIG. 6] A schematic diagram showing a third embodiment of the toner supply device of the present invention.

FIG. 6 shows a third embodiment of the toner supply device according to the present invention. The toner supply device 3*c* shown in this figure differs from that of the first embodiment in that a pitch L3 of the blade 362 of the transport screw 36 opposite the second opening portion 35 is greater than the pitch L1 immediately on the upstream side in the transport direction with respect to the upstream end S2 of the second opening portion 35 in the transport direction. In this way, in the region of the second opening portion 35, the compression force applied to the toner is reduced, the toner is more likely to separate from the blade 362 of the transport screw 36 and the toner is smoothly and stably supplied to the development device 19. Moreover, since, in the embodiments described above, the width W2 of the second opening portion 35 is greater than the width W1 of the first opening portion 34, the toner is stably and smoothly supplied to the development device 19 through the joint 39.

In the toner supply device described above, the outside diameter of the blade 362 of the transport screw 36 is preferably kept constant regardless of the pitch of the blade 362 being changed. The space between the outside diameter of the blade 362 of the transport screw 36 and the inside diameter of the transport pipe 33 is preferably kept constant regardless of the pitch of the blade 362 being changed.

What is claimed is:

1. A toner supply device comprising:

a toner storage portion storing toner; and a transport unit transporting the toner in the toner storage portion to a development device, the transport unit comprising:

a transport pipe with a first opening where the toner is fed from the toner storage portion and a second opening downstream of the first opening through which the toner is fed to the development device;

a transport screw with a helical blade formed on a rotation shaft, the transport screw being provided in the transport pipe;

the first opening of the transport pipe having a width greater than a pitch of the helical blade at the first opening; and the helical blade having a first pitch along the length of the transport screw that is adjacent the first opening and wherein, at the location of a downstream end of the first opening, the pitch transitions to a second pitch narrower than the first pitch.

2. The toner supply device of claim 1, wherein the transport pipe is arranged in a bottom portion of the toner storage portion, and the first opening portion is an opening formed in an upper side portion of the transport pipe.

3. The toner supply device of claim 1, wherein the pitch of the blade becomes narrower either continuously or stepwise from the downstream end of the first opening portion in a transport direction to an upstream end of the second opening portion in the transport direction.

4. The toner supply device of claim 1, wherein the pitch of the blade at the second opening portion is greater than a pitch immediately before the upstream end of the second opening portion in a transport direction.

5. The toner supply device of claim 1, wherein a width of the second opening portion in a direction of the rotational shaft is greater than the width of the first opening portion in the direction of the rotational shaft.

6. An image forming apparatus that includes a development device and a toner supply device which supplies toner to the development device, wherein, as the toner supply device, the toner supply device of claim 1 is used.

* * * * *